United States Patent [19]

Lalumiere et al.

[11] Patent Number: 4,858,394

[45] Date of Patent: Aug. 22, 1989

[54] FREE STANDING PHOTORESIST MASK AND THE METHOD OF USING THE SAME FOR ABRASIVE ENGRAVING

[75] Inventors: Robert J. Lalumiere; Jay M. Boucher, both of Enfield Center, N.H.

[73] Assignee: Dynamat, Inc., Concord, N.H.

[21] Appl. No.: 27,474

[22] Filed: Mar. 18, 1987

[51] Int. Cl.[4] ..... B24B 1/00

[52] U.S. Cl. ..... 51/312; 101/128.21

[58] Field of Search ..... 51/310, 311, 312; 101/128.21

[56] References Cited

U.S. PATENT DOCUMENTS

| | | | |
|---|---|---|---|
| 1,720,568 | 7/1929 | Philip | 51/311 |
| 1,784,495 | 12/1930 | O'Neil | 51/311 |
| 1,882,526 | 10/1932 | Smith | 51/310 X |
| 2,025,457 | 12/1935 | Kavanaugh | 101/128.21 |
| 2,270,945 | 1/1942 | Frick | 51/311 |
| 2,292,996 | 8/1942 | Helgeson | 51/311 |
| 2,385,562 | 9/1945 | Baczewski | 101/128.21 |
| 2,969,732 | 1/1961 | Kendall | 101/128.21 X |
| 3,117,403 | 1/1964 | Jack et al. | 51/311 |
| 3,532,052 | 10/1970 | Erickson | 101/128.21 X |
| 3,584,576 | 6/1971 | Kubo | 101/128.21 X |
| 4,362,808 | 12/1982 | Otthofer | 101/128.21 X |
| 4,587,186 | 5/1986 | Nakamura et al. | 51/310 X |

FOREIGN PATENT DOCUMENTS 2133326 7/1984 United Kingdom ..... 51/310

*Primary Examiner*—Frederick R. Schmidt
*Assistant Examiner*—Shirish Desai
*Attorney, Agent, or Firm*—Janine J. Weins; Michael J. Weins

[57] ABSTRACT

The present invention is directed to a new and improved method for engraving abradable surfaces such as marble, granite, slate, glass or wood and to the mask used for the engraving. The mask is formed from a porous material such as a cloth, which is covered with a photoresist emulsion. The mask is formed by selectively exposing the photoresist. To engrave a surface the mask is first positioned on the surface to be engraved and the mask is next impacted by an abrading substance. The surface not protected by the mask is abraded and a pattern is engraved into the surface. Using the present invention no chemical interaction need occur between the mask and the surface to be engraved, and only sandblasting equipment is required. The mask can be produced remote from the engraving site and stored. Two or more masks can be overlaid to engrave intricate designs.

1 Claim, 3 Drawing Sheets

FREE STANDING PHOTORESIST MASK AND THE METHOD OF USING THE SAME FOR ABRASIVE ENGRAVING

FIELD OF INVENTION

The present invention is directed to a technique for engraving, and in particular to the use of a photoresist mask and to the method employing such a mask for engraving hard abradable surfaces such as granite grave markers and stone monuments.

BACKGROUND ART

Since the stone age, people have cut, scraped or otherwise abraded away portions of stones, such as cave walls, sedimentary rock tablets, and granite boulders, to engrave inscriptions and designs that the engraver intends to survive his own mortality. Today the same basic techniques as have been employed for centuries are being used to engrave hard abradable surfaces.

Engraved stones are used as grave markers, monuments, art objects, and in structures for dedication or decorative purposes. Stone surfaces can be engraved by hand cutting letters and designs with a hammer and chisel, however, more recently power engraving tools have been used. The text, symbols and designs can be formed freehand, or a pattern can be used.

The process of engraving stone is time consuming and labor intensive. In part because of the labor required, the cost of engraving a surface, such as a stone monument, is high.

Recently, in an effort to reduce costs and speed the process, sandblasting has been employed to engrave hard abradable surfaces. When sandblasting is utilized a sandblast resistant mask can be formed in situ on the hard abradable surface. One method of forming a mask is to apply a layer of sandblast resistant emulsion directly to the surface and then selectively expose the emulsion. After exposure the emulsion is developed. The surface is then washed and the regions to be sandblasted are left exposed. The mask protects those regions of the surface which are not to be engraved. Once this process is initiated it must be carried forward quickly. Sandblasting, or hand engraving can then be done through the mask.

Alternatively, a precut mask can be placed over the surface to be engraved. All regions of the precut mask must be interconnected and the process of preparing the mask is labor intensive.

There is a need for a method whereby a detailed free standing mask can be formed, transferred to, and subsequently used to engrave a pattern into a hard abradable surface such as marble or granite.

SUMMARY OF INVENTION

It is an object of the present invention to provide a mask which can be used for engraving stone.

It is another object of the present invention to provide a free standing mask which can be produced by photographic techniques.

Still another object of the present invention is to provide a mask which can be prepared remote from the engraving site and at a subsequent time be readily transported to the engraving site.

It is an object of the present invention to reduce the cost and time required for engraving monuments.

It is an object of the present invention to provide a technique which can be used for making an engraving in a stone having various qualities of engravement.

It is a further object of the present invention to provide a method whereby detailed engravings can be made in the surface of a stone.

It is yet another object of the present invention to provide a technique whereby a stone having a non-planar surface can be engraved with an intricate design.

It is yet another object of the present invention to provide a method which can be used to engrave a similar pattern in a variety of stones at different times and at different sites.

It is yet another object of the present invention to provide a method whereby a pattern can be transferred to a glass so as to make a frosted glass surface.

It is yet another object of the present invention to provide a means whereby a pattern can be engraved into any hard abradable surface.

It is yet another object of the present invention to make an engraved pattern in a hard surface in which one or more details of the pattern are separated by a continuous path of engraved surface.

The present invention is directed to a new and improved technique for engraving inscriptions, symbols and patterns into hard abradable surfaces.

In particular, the present invention is directed to a free standing photoresist mask and the method of using the same for abrasive engraving the surface of hard abradable materials such as marble, granite, slate, glass or wood.

The process of the present invention requires only, equipment for abrading the hard surface, such as sandblasting equipment, and a free standing mask produced in accordance with the present invention.

To practice the method of the present invention an engraver adheres the free standing mask produced in accordance with the present invention to the surface which is to be engraved. After the mask is positioned on and affixed to the surface a technique is used whereby those portions of the hard surface which lie beneath the portions of the mask which do not provide protective cover are aggressively removed. Sandblasting is a preferred method of aggressively removing portions of the surface.

Because of the structure of the mask of the present invention, those portions of the mask which cover regions of the surface to be engraved can be readily abraded away to expose the underlying surface. Sandblasting the surface through the mask causes the surface that is not protected by the mask to be abraded and a pattern to be formed in the underlying surface. After the pattern has been formed the mask is removed leaving an engraved surface.

Using the present technique it is possible to avoid a chemical reaction between the mask and the engraving surface since no chemical interaction between the mask and the engraving surface is required.

The present technique allows the engraver to overlay two or more masks in such a manner as to engrave intricate designs and to use different engraving techniques for different portions of the design.

The present mask can be made off site, can be stored for extended periods of time, and can be shipped and transported with ease.

Using the present invention it is possible to form a mask having a design, store the mask and at a subsequent time, cut an additional design into the mask. In this manner the masks for the gravemarkers of various members of a family can be formed before their death, and after their death the date of death can be hand cut into the mask before the mask is used for engraving the gravemarker.

The mask of the present invention is formed from a sheet of porous material, portions of the sheet are covered by an abrasion resistant material. The porous material serves as a carrier for the sandblast resistant material and must have sufficient structural integrity to maintain the spacial relation of the sandblast resistant components.

Using the present invention it is possible to engrave designs having nonengraved regions which are surrounded by engraved regions. For example, the letters "O" and "P" can be formed in the traditional manner such that there is a continuous engraved region surrounding a nonengraved island in the center of the "O" or in the center of the "P".

To fabricate the engraving mask of the present invention a porous cloth is evenly stretched over and fastened to a rigid frame. The cloth is coated with a light sensitive emulsion known as a photoresist. After the mask has been coated with the photoresist and dried, the emulsion is selectively exposed to ultraviolet light through a positive representing the desired image field. The mask is then washed with a high pressure water spray such that those regions of the mask where the emulsion remains are abrasion resistant.

The photoresist mask is bonded to the surface to be engraved with an adhesive such as a glue or an epoxi. The adhesive should be selected such that it will allow the mask to be subsequently released without discoloring or in other manners altering the underlying surface.

When using the present mask in combination with an abrasive process such as sandblasting, the sand abrades the portions of the porous material that are not coated with the abrasive resistant emulsion thereby exposing the underlying hard abradable surface. Thus, by using the mask of the present invention portions of the substrate will be abraded while the surrounding material which is covered by the abrasion resistant cured emulsion will be protected.

BEST MODE FOR CARRYING THE INVENTION INTO PRACTICE

Figure 1:
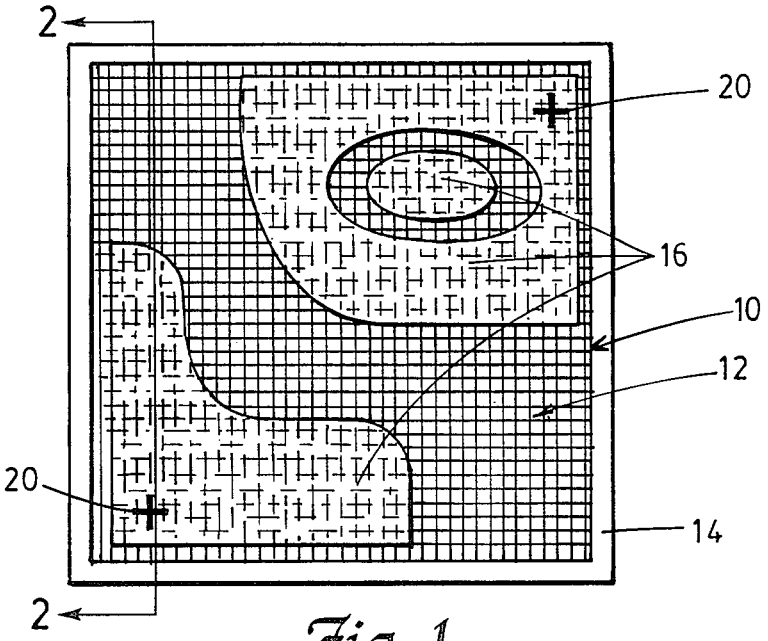
FIG. 1 is a schematic representation of a mask of the present invention.

The present invention is directed to a new and improved technique for engraving inscriptions and designs in hard abradable surfaces such as stone. In particular, the present invention is directed to a free standing photoresist mask and the method of using the same for engraving hard abradable surfaces such as stone, and in particular, granite stones used for grave markers.

To produce the mask of the present invention a porous material, such as a cloth, is stretched over a rigid frame and fastened thereto. The cloth is coated with a special light sensitive emulsion known as photoresist. The photoresist is dried and selectively exposed. The exposed emulsion is treated so as to produce a mask having regions that are abrasion resistant and regions that are sandblast abradable.

To engrave a surface in accordance with the present invention the mask is adhered to the surface to be engraved. Adhesives such as 3M Super 77 can be used to adhere the mask to the hard abradable surface. After the mask is positioned and affixed to the surface the mask is abraded using a process such as sandblasting. Those portions of the mask not protected by the abrasion resistant emulsion are rapidly abraded away exposing the underlying hard abradable surface to aggressive attack by the abrading medium. After the regions not protected by the mask have been abraded to the depth required, the mask is removed leaving a fully engraved surface.

In one preferred embodiment of the present invention, inscriptions and designs having regions of different quality of engravement are formed by using two or more free standing photoresist masks made in accordance with the present invention. Using two or more masks the present invention allows the engraver to overlay the masks in such a manner as to engrave intricate designs into the surface and to use different cutting and etching techniques with respect to different letters or portions of the design.

This sequence of masks is analogous to traditional screening technique used in lithography to make multicolored lithographs. In this technique one mask can be used for making characters which may be blasted by a course grain sand, while another mask can be used to form characters formed by a very fine grain sand. Thus characters having different surface texture qualities can be formed on the same stone. If prior art techniques were used different chisels might have to be used to form characters having different qualities.

Free standing photoresist masks of the present invention can be made off site, can be stored for extended periods of time, and can be shipped and transported with ease. Thus the masks allow a surface to be engraved on site with the only equipment requirement being sandblasting equipment or other such equipment which allows portions of a surface to be abraded away.

Emulsion materials such as Chromaline SBX and Ulano T2/HY-200B are suitable for use as the photoresist emulsion. A pattern is used to expose the emulsion. After the emulsion has been exposed it is developed. The developed emulsion remains intact and affixed to the porous cloth. The developed emulsion forms the mask which prevents the underlying surface from being impacted by the abrading material such as sand. The unexposed emulsion can be washed from the cloth leaving a pattern on the cloth that has the same characteristics as the pattern to be engraved on the stone.

The cloth essentially forms a carrier for the abrasive resistant developed emulsion. The photoresist mask can be used to form a design in which portions of the hard surface which are not abraded are surrounded by portions which are abraded, thus the cloth holds the abrasion resistant mask component in spacial relationship. Thus the cloth acts as a carrier for the abrasion resistant emulsion.

When the mask is impacted by the abrading material, such as the sandblast, the cloth portion is abraded away thus exposing the underlying surface. It has been found that natural fibers are preferred since they are more readily broken down by the action of the abrasive. The developed emulsion serves to protect those portions of the surface covered by the developed emulsion from the aggressive action of the abrading material.

Figure 2:
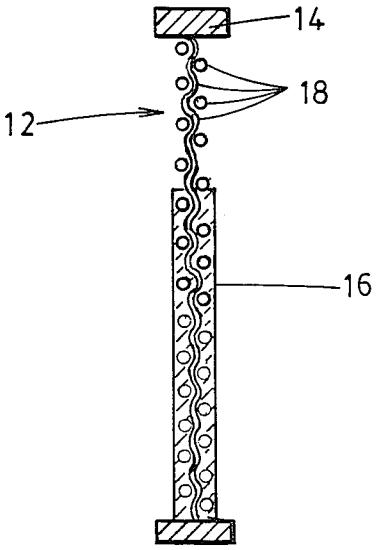
FIG. 2 is section 2—2 of the mask shown in FIG. 1.

FIG. 1 is a schematic representation of a photoresist mask of the present invention. The mask 10 is formed on a porous material 12 which is preferably a cloth or other woven fabric. The porous material 12 is optionally attached to a rigid frame 14. A photoresist pattern 16 adheres to portions of the porous material 12. The photoresist pattern 16 is formed from a light sensitive emulsion which upon exposure becomes resilient and abrasion resistant, preferrably the photoresist pattern 16 penetrates the porous material 12 as is shown in FIG. 2.

Figure 3:
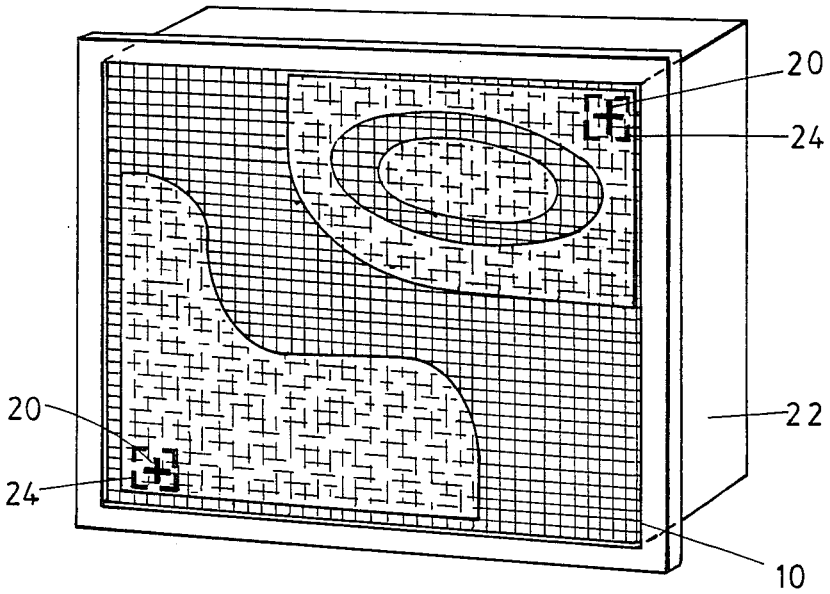
FIG. 3 is a schematic representation of the mask placed in contact with the surface to be engraved.

The photoresist mask of FIG. 1 may be applied to a stone surface as shown in FIG. 3. The photoresist portions are attached to a surface of the stone 22 by an adhesive. The adhesive must be such that it will hold the photoresist mask 10 in place during the abrasive engraving such as sandblasting. Additionally, the adhesive must allow the mask 10 to be released from the surface without damaging the surface. The mask may be placed in position over the surface with or without a frame.

When multiple masks are to be applied, or the exact location of the pattern on the stone is critical, indexing marks 20 can be provided on the mask 10. The index marks 20 can be slits which pass through the mask 10 and index tabs 24 attached to the surface of the stone 22. The tabs 24 have a pattern which allows for easy alignment of the index marks 20 on the mask 10. After the mask has been sandblasted and the pattern engraved in the stone 22, the abrasive resistant portions of the mask are removed. If a second overlay mask is to be used, such as shown in FIG. 4, the tabs 24 can be employed to index a second mask 40 with index marks 42, which are provided to preserve the spacial relationship of the second mask 40 to the engraved pattern which was formed using the first mask 10.

Figure 4:
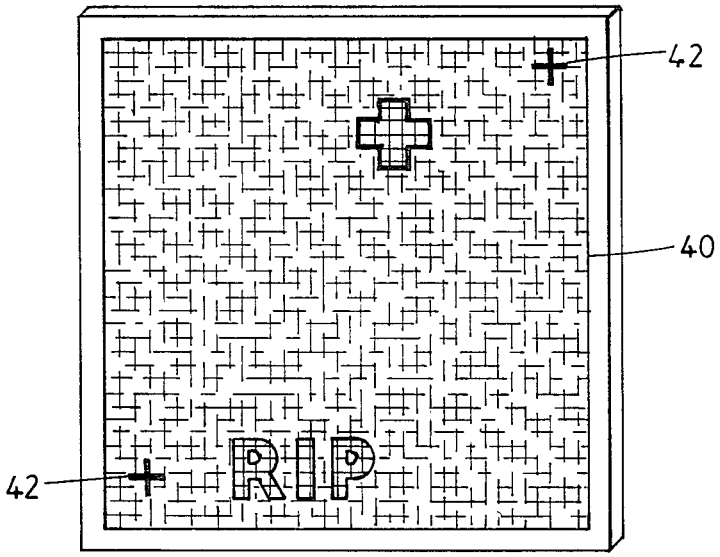
FIG. 4 is a schematic representation of a second mask used to over engrave a surface in accordance with one embodiment of the present invention.
Figure 5:
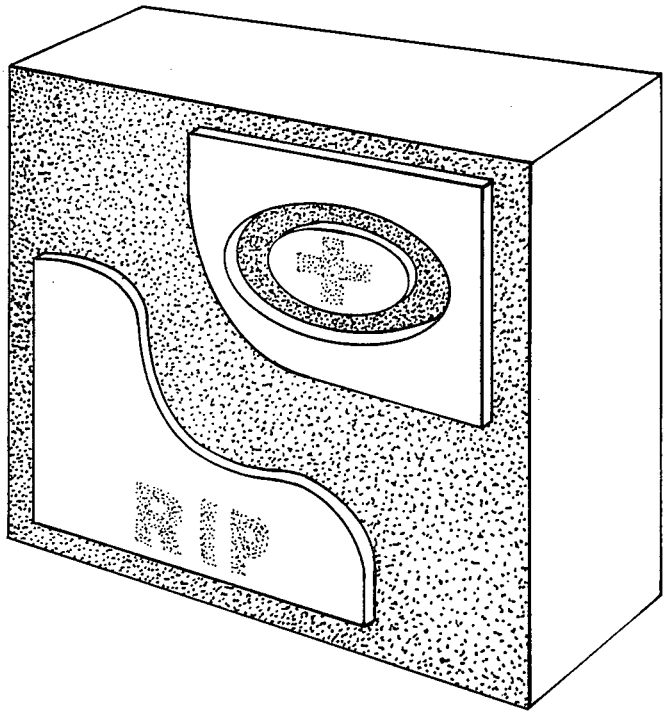
FIG. 5 is a schematic representation of a surface that has been engraved using a two mask technique in accordance with the present invention.

FIG. 5 is a schematic representation of a surface after a two stage sandblasting process, using the masks of FIG. 1 and FIG. 4. If the sand used for the second sandblasting is finer a finer grain engraving will be formed, thus engravings can have varied texture.

EXAMPLE

A percale cloth was fastened to a frame. Chromaline SBX emulsion was coated on the percale cloth and dried to form a layer of about 0.125 inches. The emulsion was then selectively exposed to a light. The light source was a Quartz W/Flourescent AK Atlas 4-way Exposure unit. The nonexposed emulsion was removed with high pressure (125 psi) water wash which was applied for a period of 4 minutes. The above steps produced a free standing mask having a photoresist pattern developed therein.

The free standing mask was then attached to a stone surface by 3M Super 77 adhesive. The mask so attached to the stone surface was sandblasted with a medium mesh sand using a standard sandblaster. The sandblasting continued for a period of 5 minutes and resulted in a surface having a depth of approximately 0.125 inches. Thereafter, a Napthan based solvent was used to remove the photoresist mask.

While the present invention has been described in terms of preferred embodiments and particular applications substitution to the method by one skilled in the art can be made without departing from the spirit of the invention.

What we claim is:

1. "Method of making a photo resist free standing mask of woven cloth for use in abrasive engraving comprising the steps of:

stretching a sheet of said woven cloth on a frame, impregnating said woven cloth with a photoresist emulsion having a thickness range of 0.002 inch and 0.125 inch, exposing said photoresist emulsion to light, and washing away said unexposed emulsion with water at a pressure of at least 125 psi."

* * * * *